US009795258B2

(12) United States Patent
Keily et al.

(10) Patent No.: US 9,795,258 B2
(45) Date of Patent: Oct. 24, 2017

(54) DISPENSER APPARATUS WITH DAMPER FOR DISPENSING PAPER TOWELING

(71) Applicant: DISPENSING DYNAMICS INTERNATIONAL, City of Industry, CA (US)

(72) Inventors: Joel P. Keily, Corona, CA (US); Orlando Pedro Ochoa, Sr., Walnut, CA (US)

(73) Assignee: Dispensing Dynamics International, LLC, City of Industry, CA (US)

( * ) Notice: Subject to any disclaimer, the term of this patent is extended or adjusted under 35 U.S.C. 154(b) by 517 days.

(21) Appl. No.: 14/468,440

(22) Filed: Aug. 26, 2014

(65) Prior Publication Data

US 2015/0305578 A1 Oct. 29, 2015

Related U.S. Application Data

(60) Provisional application No. 61/873,906, filed on Sep. 5, 2013.

(51) Int. Cl.
*A47K 10/36* (2006.01)
*A47K 10/38* (2006.01)

(52) U.S. Cl.
CPC ..... *A47K 10/38* (2013.01); *A47K 2010/3675* (2013.01); *A47K 2010/3863* (2013.01)

(58) Field of Classification Search
CPC ..... A47K 10/38; A47K 2010/3863; A47K 2010/3675; A47K 10/34; A47K 10/32; B65H 16/06; B65H 2403/72
See application file for complete search history.

(56) References Cited

U.S. PATENT DOCUMENTS

| | | | | |
|---|---|---|---|---|
| 5,938,142 | A * | 8/1999 | Halperin | A47K 10/38 242/423.1 |
| 5,988,561 | A * | 11/1999 | Mele | A47K 10/40 242/599.1 |
| 6,314,850 | B1 * | 11/2001 | Morand | A47K 10/3643 83/322 |
| 6,439,501 | B1 * | 8/2002 | Harmathy | A47K 10/38 242/565 |
| 7,500,420 | B2 | 3/2009 | Cvjetkovic et al. | |
| 2016/0157682 | A1 * | 6/2016 | Keily | A47K 10/38 242/563.2 |
| 2016/0242603 | A1 * | 8/2016 | Cvjetkovic | A47K 10/38 |

* cited by examiner

*Primary Examiner* — William A Rivera
(74) *Attorney, Agent, or Firm* — Thomas R. Lampe

(57) ABSTRACT

Apparatus for dispensing paper toweling from a roll of paper toweling including roll support structure, a rotatable support drum to transport the paper toweling and cause rotation of the roll of paper toweling, and a rotary damper resisting formation of overspin slack in the paper toweling resulting from a pulling force applied to the paper toweling.

10 Claims, 5 Drawing Sheets

DISPENSER APPARATUS WITH DAMPER FOR DISPENSING PAPER TOWELING

This application is based on and claims the benefit of U.S. Provisional Patent Application No. 61/873,906, filed Sep. 5, 2013.

TECHNICAL FIELD

This invention relates to dispenser apparatus for dispensing paper toweling from a roll thereof.

BACKGROUND OF THE INVENTION

It is known generally to provide a damping system in roll paper towel dispensers to absorb the shock that occurs when roll overspin slack is taken up, thereby preventing "tabbing" during use of the dispenser.

Tabbing occurs when a piece of towel tears off the sheet when a user grasps and pulls the paper. Tabbing may occur with one or two hand pulls. Papers that absorb water at the greatest rate are most likely to tab. The rate of water absorbency varies by paper manufacturer and grade. Premium grade papers tend to absorb water the quickest and are generally harder to cut which leads to a higher rate of tabbing.

Tabbing takes place when overspin slack is taken up. A "shock" is present at the moment the overspin slack is exhausted. The shock occurs because the stationary roll towel must begin rotating at the moment the overspin slack is exhausted. The shock is greatest with full rolls and diminishes as the roll is exhausted.

U.S. Pat. No. 7,500,420, issued Mar. 10, 2009, discloses dispenser apparatus for dispensing paper toweling that includes structure for damping forces applied to a roll of paper toweling when overspin slack is taken up and wherein the timing of a cutter blade incorporated in the dispenser apparatus is modified to reduce peak pull force during dispensing. A biased damping roller is displaceable by the toweling when the toweling is pulled to take up the slack and maintain the toweling in taut condition between the end being pulled and the roll.

Paper companies continue to introduce bigger, heavier rolls with smaller core diameters and in some cases proprietary roll support plugs. Paper companies, for example, currently are making paper toweling rolls 10 inches in diameter and having 1,500 feet of paper.

This creates an even greater challenge when dealing with overspin. The biased damping roller approach disclosed in U.S. Pat. No. 7,500,420 may not be adequate to effectively control overspin in certain bigger, heavier rolls.

Overspin can create the following negative dispensing issues for dispensers including self cutting mechanisms, such as drum mounted tear blade systems, an example of which is disclosed in U.S. Pat. No. 7,500,420.

Among the problems is double sheeting. This can happen in two ways. One, on fast pulls the drum can over-rotate, dispensing the next sheet still attached to the first.

Two, the overspun toweling has no tension against the tear blade, which can reduce cutting effectiveness.

Another problem is the tabbing discussed above caused by the shock force created to get the roll spinning.

DISCLOSURE OF INVENTION

In accordance with the teachings of the present invention, a rotary damper is operatively associated with structure of a dispenser apparatus for dispensing toweling from a roll thereof. The term "toweling" as employed herein includes paper towels and toilet tissue.

The rotary damper resists rotation of the roll during dispensing to prevent overspin.

More particularly, according to one embodiment of the invention, the rotary damper, which may be of any suitable type, such as a geared type or a suitable non-gear type such as a viscous shear type damper, is located at the roll support arm or other roll support.

In other embodiments the rotary damper is at the toweling sheet support drum or at an intermediate roller of a dispenser.

Benefits include (a) overspin control and (b) reduced double sheeting by preventing the mechanism from free spinning.

MODES FOR CARRYING OUT THE INVENTION

Figure 1:
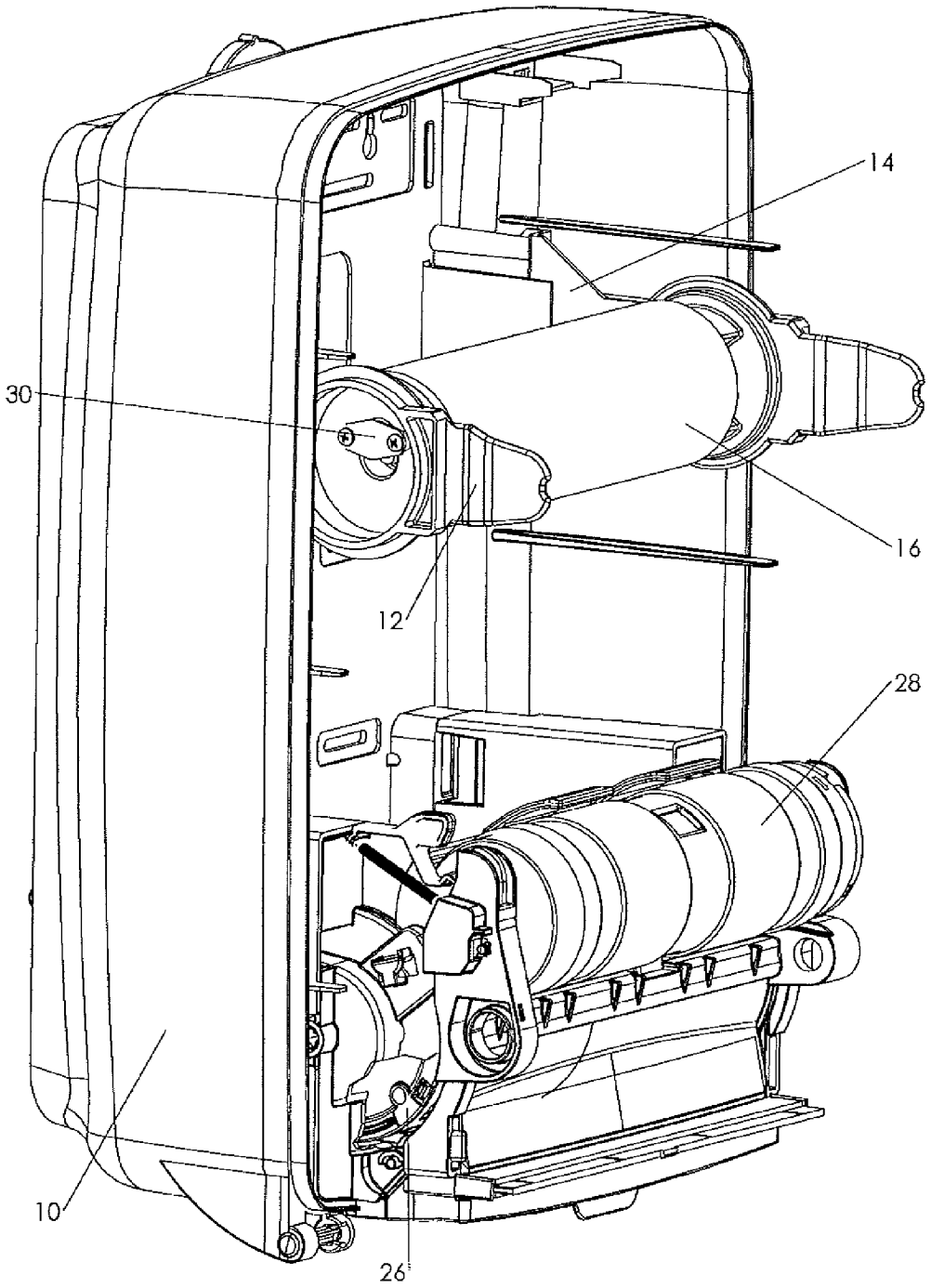
FIG. 1 is a left frontal, perspective view illustrating the interior of a paper towel dispenser apparatus rear cabinet portion and selected structural operating components of the dispenser apparatus, a rotary damper on the left roll support arm, and a partially depleted roll of toweling supported by the support arms.
Figure 2:
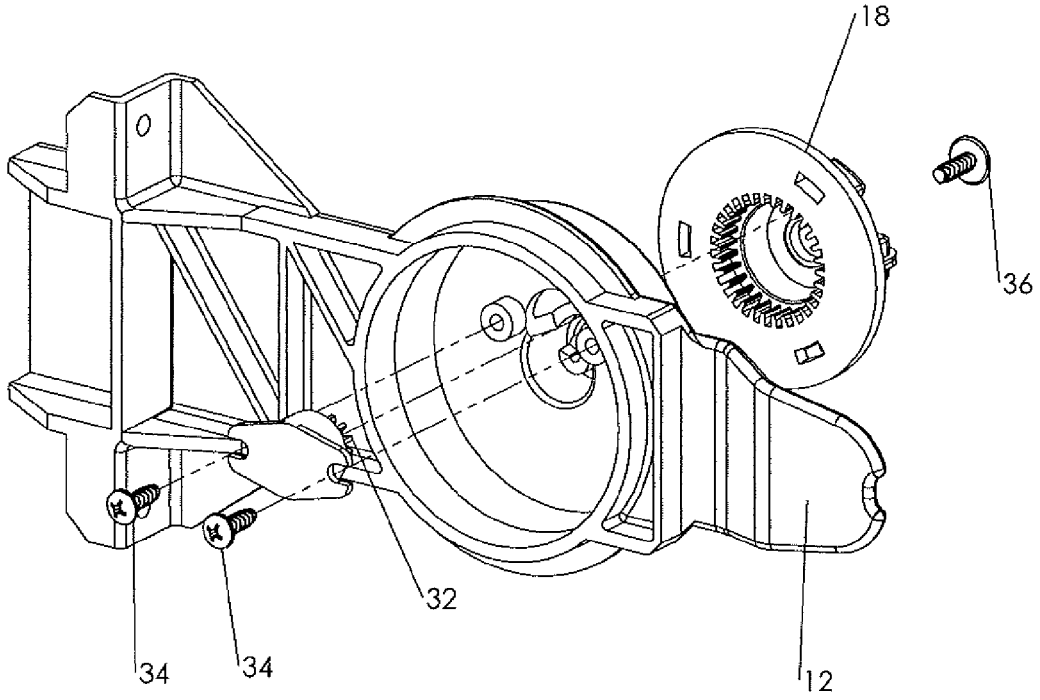
FIG. 2 is an exploded, enlarged perspective view of the left support arm and separated components of the rotary damper.
Figure 3:
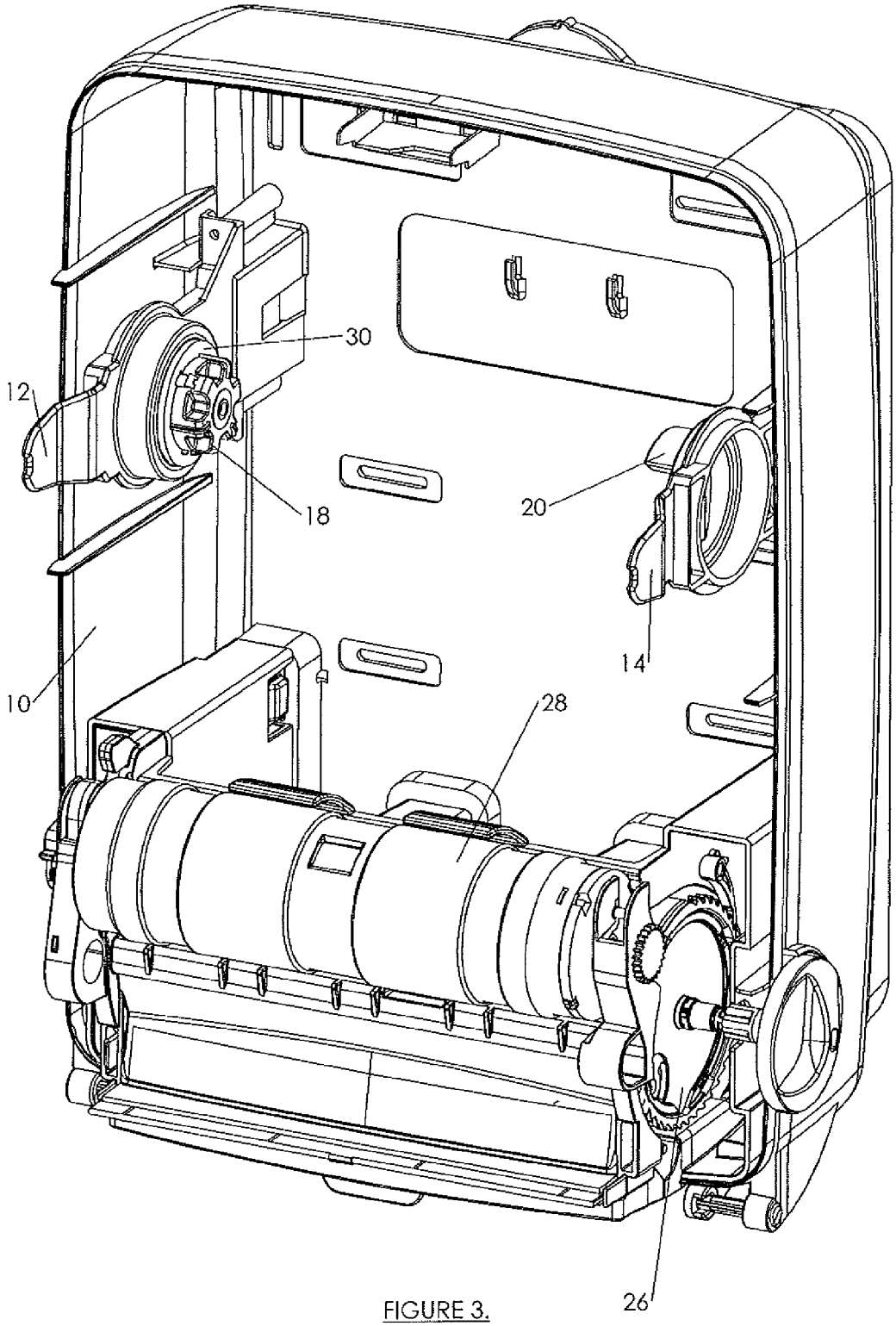
FIG. 3 is a right frontal perspective view of the FIG. 1 embodiment with the roll of toweling removed.

Referring now to the FIGS. 1-3, dispenser apparatus constructed in accordance with the teachings of the present invention is illustrated. The invention includes a cabinet, only the rear cabinet portion 10 thereof being shown. Attached to the back wall of the rear cabinet portion 10 are roll support arms 12, 14 utilized to support a roll of paper toweling 16 (shown in FIG. 1 only). In the arrangement illustrated, actual support of the roll of paper toweling 16 is accomplished by roll supports 18, 20 projecting inwardly from the roll support arms 12, 14, respectively.

Roll support 20 is of circular configuration and is affixed to roll support arm 14. Roll support 20 enters and supports one end of the roll of paper toweling, for example by being positioned in a hole formed at the end of the roll or in a support plug forming an opening at the end of the roll. The roll of paper toweling is freely rotatable with respect to roll support 20 and roll support arm 14.

The nature and function of roll support 18 will be described below.

As is conventional, the dispenser apparatus includes a toweling sheet support drum 26 mounted on a housing within the cabinet which supports toweling received from the roll of paper toweling and supports and transports the toweling so that the leading end thereof passes through an opening in the dispenser cabinet and is positioned for manual grasping by a user in a conventional manner. An intermediate roller 28 forms a nip with the support drum and is rotatable therewith during advancement of the toweling in a conventional manner, typically being rotatable by pull forces applied at the lead end of the toweling by the user.

Tabbing, as described above, can take place when the paper toweling roll produces overspin slack in the toweling. The present invention provides a unique and effective approach for controlling overspin and preventing slack in the toweling between the roll 16 and the support drum 26.

A rotary damper 30 is on the roll support arm 12, the roll support 18 comprising a portion of the damper assembly. The rotary damper illustrated is of a gear-type. FIG. 2 illustrates inner rotary damper gear component 32 of the rotary damper prior to being affixed to roll support arm 12 by screws 34 and prior to assembly thereof with geared roll support 18. Rather than screws, any other suitable means of attachment, such as snap fits, may be utilized. The roll support 18 is rotatably attached to the roll support arm by any suitable means, such as threaded connector 36. The inner rotary damper gear component 32 is in an offset position so that the gear thereof engages the gear of geared roll support 18.

In operation, the roll support 18 may be positioned either in an open end of a roll of toweling or in the interior of an end plug of the roll. The roll support 18 is constructed to frictionally or otherwise be secured to the roll of paper either directly or by an end plug (not shown) to rotate with the roll of paper toweling. Thus, rotation of the roll of paper toweling is resisted by the rotary damper assembly and little or no overspin slack will be produced during the dispensing operation.

Figure 4:
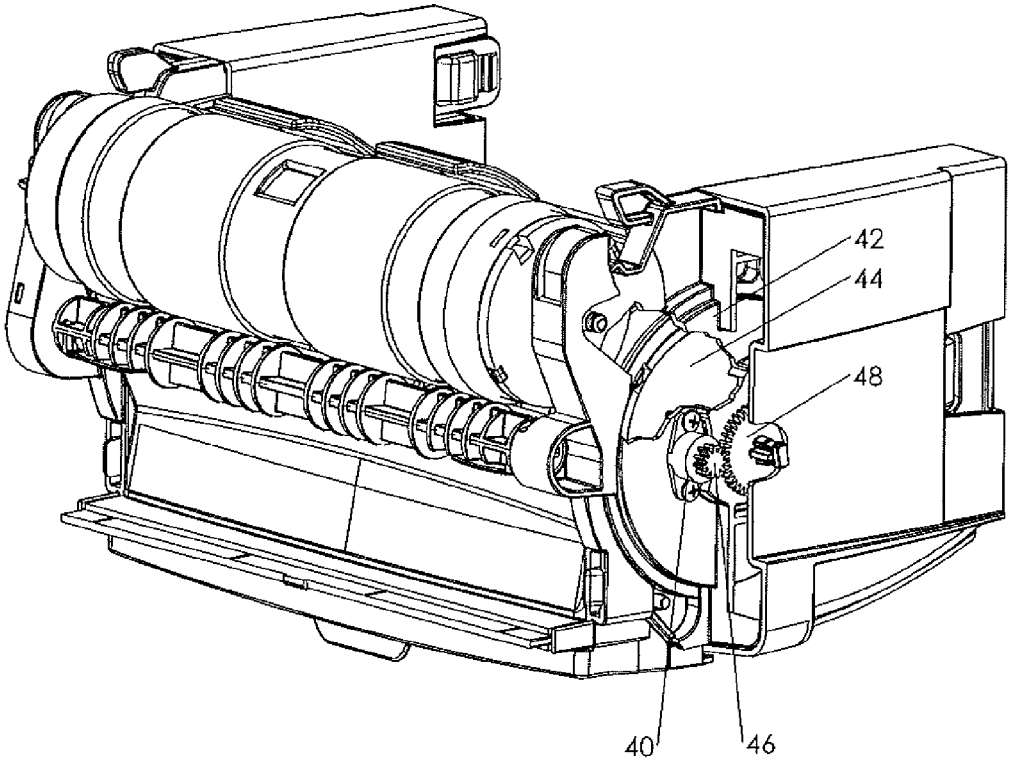
FIG. 4 is a perspective view of selected operational components of a second embodiment wherein a rotary damper is operatively attached to the rotatable toweling support drum, no cabinet or toweling being illustrated.

FIG. 4 illustrates an arrangement wherein a rotary damper 40 of a gear-type is attached to a housing 42 at the end of a toweling sheet support drum 44. The housing is positionable in a cabinet (not shown in FIG. 4) such as the cabinet illustrated in FIGS. 1-3. A gear 46 of the rotary damper 40 meshes with a gear 48 fixedly attached to and rotatable with support drum 44, this arrangement serving to resist rotation of the support drum and prevent overspin thereof and consequent formation of toweling slack.

Figure 5:
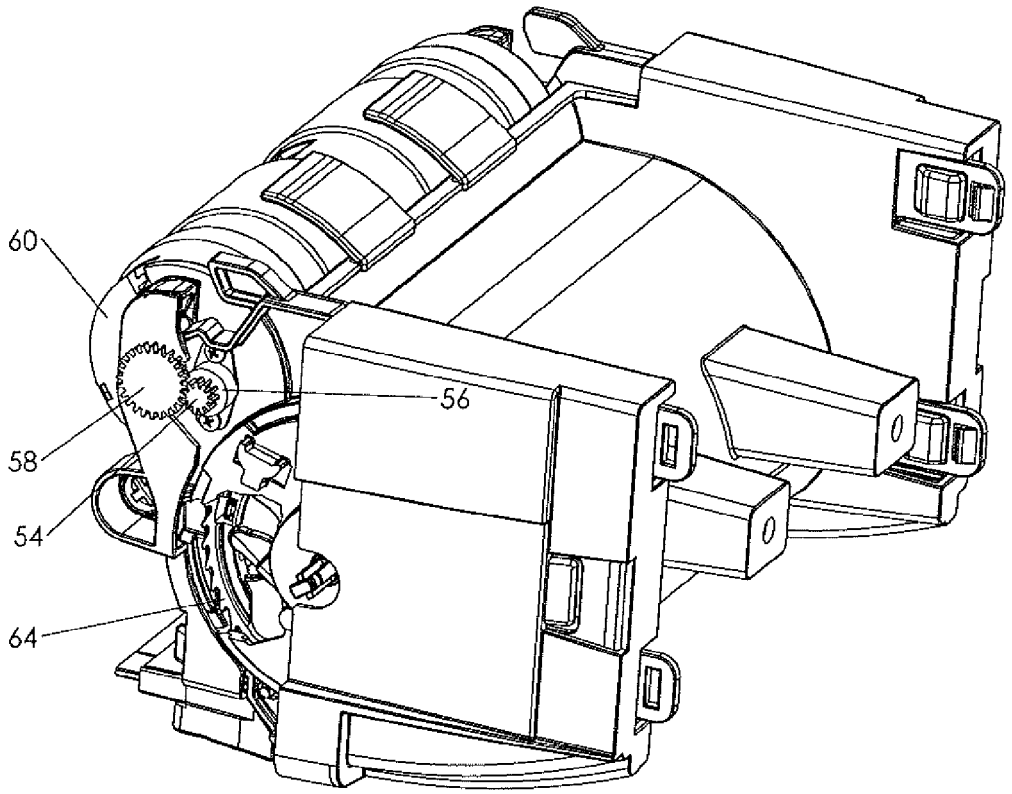
FIG. 5 is a view similar to FIG. 4, but illustrating a rotary damper operatively attached to an intermediate roller.

FIG. 5 illustrates another embodiment of the invention which is positionable in a cabinet (not shown in FIG. 5) such as the cabinet illustrated in FIGS. 1-3. In this arrangement a gear 54 of rotary damper 56 meshes with a gear 58 attached to intermediate roller 60 and rotatable therewith. Since intermediate roller 60 forms a nip with the toweling sheet support drum 64, rotation of the toweling sheet support drum will be impeded and overspin prevented.

Rotary dampers per se of both gear and non-gear types are known. Although a gear-type damper is disclosed herein, it is to be understood that non-geared rotary dampers may be utilized instead. For example, a non-geared rotary damper might be on a roll support with the rotary damper axis mounted on the center axis of rotation and could be attached to the fixed or moving side and connected by means of a keyed shaft.

Use of a rotary damper device in the present invention with structural components of roll paper toweling dispensers is unique and performs the unique function of preventing overspin that would otherwise result in poor or failed performance for the reasons indicated above when dispensing paper toweling.

The principles of the present invention are not only applicable to paper toweling dispensers which are actuated by a user directly grasping and pulling the paper toweling, but to paper toweling dispensers in which overspin can be created, for example lever/push bar dispensers, by pulling forces exerted on the paper toweling by mechanism actuated by a user. Rapid actuation by a user can create overspin in some instances.

The invention claimed is:

1. Paper toweling dispenser apparatus for dispensing paper toweling from a roll of paper toweling and resisting formation of paper toweling overspin slack, said apparatus including in combination:

a cabinet;

roll support structure within said cabinet for supporting a roll of paper toweling with said roll of paper toweling being rotatable relative to said roll support structure;

a support drum spaced from said roll support structure for supporting paper toweling unwound from said roll of paper toweling to transport the paper toweling and cause rotation of said roll of paper toweling relative to said roll support structure when a pulling force is applied to the paper toweling causing dispensing thereof; and a rotary damper for substantially or wholly preventing formation of overspin slack in said paper toweling within said cabinet resulting from said pulling force, said rotary damper fixedly mounted within said cabinet and spaced from and non-engageable with the paper toweling, said rotary damper including a rotatable rotary damper component connected to at least one of said roll support structure and said support drum.

2. The paper toweling dispenser apparatus according to claim 1 wherein said roll support structure includes a roll support arm and wherein said rotary damper is located on said roll support arm for resisting rotation of said roll of paper toweling.

3. The paper toweling dispenser apparatus according to claim 1 wherein said rotary damper is operatively connected to said support drum to resist rotation of said support drum.

4. The paper toweling dispenser apparatus according to claim 3 including a housing, and wherein said rotary damper includes relatively movable first and second rotary damper components, one of said first and second rotary damper components affixed to said housing and the other of said first and second rotary damper components connected to said support drum and rotatable when said support drum is rotated.

5. The paper toweling dispenser apparatus according to claim 4 wherein said rotary damper is a gear-type rotary damper, said first and second rotary damper components comprising gears.

6. The paper toweling dispenser apparatus according to claim 1 additionally comprising an intermediate roller forming a nip with said support drum and rotatable with said support drum to transport the paper toweling through said nip, said rotary damper operatively connected to said intermediate roller to resist rotation of said intermediate roller and said support drum.

7. The paper toweling dispenser apparatus according to claim 6 including a housing, and wherein said rotary damper includes relatively movable first and second rotary damper components, one of said first and second rotary damper components affixed to said housing and the other of said first and second rotary damper components connected to said intermediate roller and rotatable when said intermediate roller is rotated.

8. The paper toweling dispenser apparatus according to claim 7 wherein said rotary damper is a gear-type rotary damper, said first and second damper components comprising gears.

9. Paper toweling dispenser apparatus for dispensing paper toweling from a roll of paper toweling and resisting formation of paper toweling overspin slack, said apparatus including in combination:

a cabinet;

roll support structure within said cabinet for supporting a roll of paper toweling with said roll of paper toweling being rotatable relative to said roll support structure;

a support drum spaced from said roll support structure for supporting paper toweling unwound from said roll of paper toweling to transport the paper toweling and cause rotation of said roll of paper toweling relative o said roll support structure when a pulling force is applied to the paper toweling causing dispensing thereof; and a rotary damper for substantially or wholly preventing formation of overspin slack in said paper toweling within said cabinet resulting from said pulling force, said rotary damper located on said roll support arm for resisting rotation of said roll of paper toweling and said rotary damper comprising a gear-type rotary damper including an inner rotary gear component attached to said roll support arm and unmovable relative to said roll support arm and an outer rotary gear component rotatable relative to said inner rotary gear component.

10. The paper toweling dispenser apparatus according to claim 9 wherein said outer rotary gear component is for securement to an end of the roll of paper toweling with the roll of paper toweling rotatable with said outer gear component relative to said inner rotary gear component.

* * * * *